US008978171B1

(12) United States Patent
Wise

(10) Patent No.: US 8,978,171 B1
(45) Date of Patent: Mar. 17, 2015

(54) METHOD AND APPARATUS FOR DEFECATION AND URINATION

(76) Inventor: David Wise, Sebastopol, CA (US)

( * ) Notice: Subject to any disclaimer, the term of this patent is extended or adjusted under 35 U.S.C. 154(b) by 731 days.

(21) Appl. No.: 13/184,048

(22) Filed: Jul. 15, 2011

Related U.S. Application Data

(63) Continuation-in-part of application No. 11/399,089, filed on Apr. 6, 2006, now Pat. No. 7,987,529.

(60) Provisional application No. 60/669,271, filed on Apr. 7, 2005.

(51) Int. Cl.
*E03D 11/00* (2006.01)

(52) U.S. Cl.
USPC ..... 4/254

(58) Field of Classification Search
CPC ..... A47K 13/00; A47K 13/12
USPC ..... 4/254, 661, 300
See application file for complete search history.

(56) References Cited

U.S. PATENT DOCUMENTS

| | | | | | |
|---|---|---|---|---|---|
| 59,150 | A | | 10/1866 | Mangeon | |
| 604,597 | A | | 5/1898 | Bliss | |
| 1,509,891 | A | * | 9/1924 | Wildman | 4/459 |
| 1,725,417 | A | * | 8/1929 | Phillips | 340/815.84 |
| 2,346,927 | A | * | 4/1944 | Lieberherr | 123/41.78 |
| 2,546,206 | A | * | 3/1951 | Arehart | 280/406.2 |
| 2,804,062 | A | * | 8/1957 | Tinker | 123/90.29 |
| 4,012,797 | A | * | 3/1977 | Kristoffersen | 4/300 |
| 4,048,679 | A | * | 9/1977 | Garnett | 4/237 |
| 4,175,294 | A | * | 11/1979 | Boyd | 4/237 |
| 4,207,628 | A | * | 6/1980 | Ibel | 4/445 |
| 4,254,514 | A | * | 3/1981 | Sakamoto | 4/234 |
| 4,294,268 | A | * | 10/1981 | Kitrell | 132/73 |
| 4,305,164 | A | * | 12/1981 | Sargent et al. | 4/462 |
| 4,446,140 | A | * | 5/1984 | Nelson | 514/289 |
| 4,584,725 | A | * | 4/1986 | Oliver | 4/254 |
| 4,709,426 | A | * | 12/1987 | Godwin, Jr. | 4/300.3 |
| 4,713,846 | A | * | 12/1987 | Hodroski, Jr. | 4/254 |
| 4,819,277 | A | * | 4/1989 | Sikirov | 4/254 |
| 5,028,024 | A | * | 7/1991 | Welles | 248/163.1 |
| 5,307,526 | A | * | 5/1994 | Appleby | 4/460 |
| 5,353,805 | A | * | 10/1994 | Mojena | 600/574 |
| 5,570,482 | A | * | 11/1996 | Asakawa | 5/81.1 C |
| 5,666,672 | A | * | 9/1997 | Birsel et al. | 4/236 |
| 5,737,780 | A | * | 4/1998 | Okita et al. | 4/667 |
| 5,765,236 | A | * | 6/1998 | Bethanis | 4/237 |
| 5,809,582 | A | * | 9/1998 | Lane | 4/254 |
| 5,809,583 | A | * | 9/1998 | Pucciani | 4/254 |
| 5,852,833 | A | * | 12/1998 | Gregoire | 4/246.3 |
| 5,896,581 | A | * | 4/1999 | Wong | 2/78.2 |
| 5,926,875 | A | * | 7/1999 | Okamoto et al. | 5/605 |
| 5,987,657 | A | * | 11/1999 | Byers | 4/254 |
| 6,000,070 | A | * | 12/1999 | Bonin | 4/349 |
| 6,003,171 | A | * | 12/1999 | Jones, Jr. | 4/667 |
| 6,070,276 | A | * | 6/2000 | Yeung | 4/442 |
| 6,148,448 | A | * | 11/2000 | Urso | 4/254 |

(Continued)

*Primary Examiner* — Lori Baker
(74) *Attorney, Agent, or Firm* — Young Basile Hanlon & MacFarlane P.C.

(57) ABSTRACT

An apparatus for use with an existing Western-style toilet having a toilet bowl facilitates use of a squatting posture thereon. The apparatus includes a platform assembly including: a mounting flange that is connectable to the toilet bowl, and a support platform that is pivotally connected to the mounting flange. The support platform defines first and second spaced-apart foot support surfaces to support a person's feet and a gap through which the person's waste products can pass.

4 Claims, 16 Drawing Sheets

(56) References Cited

U.S. PATENT DOCUMENTS

| | | | | |
|---|---|---|---|---|
| 6,256,800 | B1 * | 7/2001 | Isbit | 4/254 |
| 6,349,423 | B1 * | 2/2002 | Kelleher | 4/254 |
| 6,401,263 | B2 * | 6/2002 | Chang | 4/144.1 |
| 6,584,621 | B2 * | 7/2003 | Kim | 4/237 |
| 6,681,410 | B1 * | 1/2004 | Husain | 4/254 |
| 6,745,417 | B2 * | 6/2004 | Sumino | 4/662 |
| 7,987,529 | B1 * | 8/2011 | Wise | 4/254 |
| 8,317,268 | B2 * | 11/2012 | Alkhattaf | 297/423.39 |

* cited by examiner

METHOD AND APPARATUS FOR DEFECATION AND URINATION

CROSS-REFERENCE TO RELATED APPLICATIONS

This application is a continuation-in-part of U.S. patent application Ser. No. 11/399,089, filed Apr. 6, 2006, which claims the benefit of U.S. Provisional Application Ser. No. 60/669,271, filed Apr. 7, 2005, both of which are hereby incorporated by reference in their entirety.

FIELD OF THE INVENTION

The present invention relates in general to toilets, and more particularly, to a device for supporting a user in a squatting position while defecating or urinating into a toilet.

BACKGROUND OF THE INVENTION

It has long been appreciated that a natural posture for defecation is that of squatting. When a person squats, his or her anal canal is aligned with his or her rectum to permit easy and complete evacuation of feces. This minimizes the straining, stress and time required to defecate. Since the dawn of time, humans have defecated in the squatting position, and to this day squatting is the preferred position in many Asian countries.

In other countries, most notably those in Europe and the Americas, the squat toilet has been replaced by a conventional sitting toilet. When a person sits on a toilet while defecating, his or her pelvic muscles contort the anal canal causing the anorectal angle to remain at approximately 90 degrees, necessitating the evacuation of feces through a right angle rather than an approximately straight tube. Also, by using a seated position for defecation, much of the weight of the person is borne by his or her buttocks and blood is pooled therein by the ring of the toilet seat. As a result, a person defecating in a sitting posture must strain to evacuate, which can lead to a host of problems, including physical discomfort, hemorrhoids, constipation, pelvic organ prolapse, anal fissures, slow transit time, colon cancer, and, in certain individuals, stroke or heart attack triggered by temporarily increasing blood pressure. Because of the slowing down of the heart rate (bradycardia) during straining, defecting in a sitting position can even trigger non fatal and fatal cardiac arrhythmias. Squatting may reduce these potential problems. Squatting also assists in sealing the ileocecal valve between the colon and the small intestine, which prevents fecal matter from contaminating the small intestine.

The advantages of squatting over sitting have long been recognized. The sitting toilet, however, is ingrained in Western societies, not only through habit and custom, but also through building codes and the fact these societies have invested substantial sums of money in the existing sitting toilet infrastructure.

Many people in Western society, particularly Americans, also lack the muscular strength and, because of a shortened Achilles tendon, flexibility to assume a squatting position without significant effort and strain. This may cause them to reject squatting because they find it awkward and uncomfortable. When they do squat, because they are teetering and straining, their pelvic muscles are not fully relaxed, and this may result in puborectalis and external anal sphincter tension and sub-optimal alignment of the rectal canal, thereby not allowing them to experience the full benefits of squatting.

Inventors have for years tried to improve the defecation posture of Westerners through a variety of toilets and toilet accessories that either seek to permit squatting using a Western type toilet or to mitigate the adverse effects of the sitting posture. These past efforts have failed to effect any appreciable change in the defecation habits of Westerners. The overwhelming majority of Americans, for example, continue to sit on toilets as they have for generations. Accordingly, it is desirable to provide an apparatus for assisting a person in assuming a beneficial squatting position without significant effort and strain.

SUMMARY OF THE INVENTION

In accordance with the invention, an apparatus and method of defecation and urination is provided for enabling a user to assume a more beneficial posture while using a toilet.

In one embodiment, an apparatus for discharging bodily wastes includes a receptacle for holding a person's bodily waste products, including an upwardly facing opening for receiving the waste products; a forward load-bearing member that supports at least one foot of a person discharging waste products into the receptacle; and a rear load-bearing member arranged to engage the lower torso of the person above the buttocks when the person has at least one foot in the forward load-bearing member. The rear load-bearing member and the forward load bearing member are spaced apart a distance that is sufficient to hold a person therebetween with the person's buttocks suspended over the opening of the receptacle and the person's center of gravity behind the one foot supported in the forward load bearing member.

In another embodiment, a method for facilitating evacuation of bodily wastes into a toilet is provided including providing load bearing foot rests in front of the toilet to support suspension of the pelvis above the toilet bowl and a load-bearing surface behind the toilet bowl wherein the load bearing surface behind the toilet bowl is oriented at an angle of between approximately 90 and 125 degrees from the plane of the toilet bowl opening; placing a person's feet on the footrests at a height of no more than 5 inches above or below the plane of the bowl's upward facing opening such that the person's thighs are substantially flexed to achieve flexion of the hips above the squatting platform; and placing a portion of the person's posterior torso on the load-bearing surface so that the person's pelvis is suspended over the toilet and the person's anal canal is aligned with the person's rectum.

In another embodiment, an apparatus for use with an existing Western-style toilet having a toilet bowl facilitates use of a squatting posture thereon. The apparatus includes a platform assembly including a mounting flange that is connectable to the toilet bowl, and a support platform that is pivotally connected to the mounting flange. The support platform defines first and second spaced-apart foot support surfaces to support a person's feet and a gap through which the person's waste products can pass.

In another embodiment, an apparatus for use with an existing Western-style toilet having a toilet bowl facilitates use of a squatting posture thereon. The apparatus includes a platform assembly defining first and second spaced-apart foot support surfaces to support a person's feet and a gap through which the person's waste products can pass. A back support defining member is connected to the platform assembly. The back support defining member has a load bearing surface for engaging the back of a person squatting over the bowl. A lateral brace is connected to the platform for engaging and at least partially supporting the back support defining member.

In another embodiment, a fixture for retrofitting an existing Western-style toilet with a bolt-mounted toilet seat facilitates use of the squatting posture thereon. The fixture includes a base portion having adapted for placement on top of a toilet bowl, and spaced-apart foot support surfaces extending from the base portion to support a person's feet. The spaced-apart foot support surfaces define a gap therebetween through which the person's waste products can pass. At least one aperture is formed in the base sized to accept a toilet seat mounting bolt.

BRIEF DESCRIPTION OF THE DRAWINGS

The description herein makes reference to the accompanying drawings, wherein like reference numerals refer to like parts throughout the several views, and wherein.

DETAILED DESCRIPTION OF THE PREFERRED EMBODIMENT

An embodiment of the invention is provided that facilitates a squatting posture on a variety of toilets, including conventional Western-style toilets, including a squatting posture by persons who lack the physical strength or flexibility to comfortably maintain a free-standing squatting position. The disclosed embodiment can also facilitate urination by placing persons in a squatting posture in which his or her pelvic region is suspended over the toilet and the thighs provide a bellows action against the abdomen, thus reducing abdominal volume and increasing abdominal pressure, especially on the bladder, which may thereby increase urinary flow and reduce urinary retention.

The disclosed embodiment can be suitable for use with toilet designs that are aesthetically pleasing and that conforms to regulatory and other design limitations in Western-style bathrooms. One of the disclosed embodiments can be used to retrofit existing Western-style toilets to permit squatting.

Figure 1:
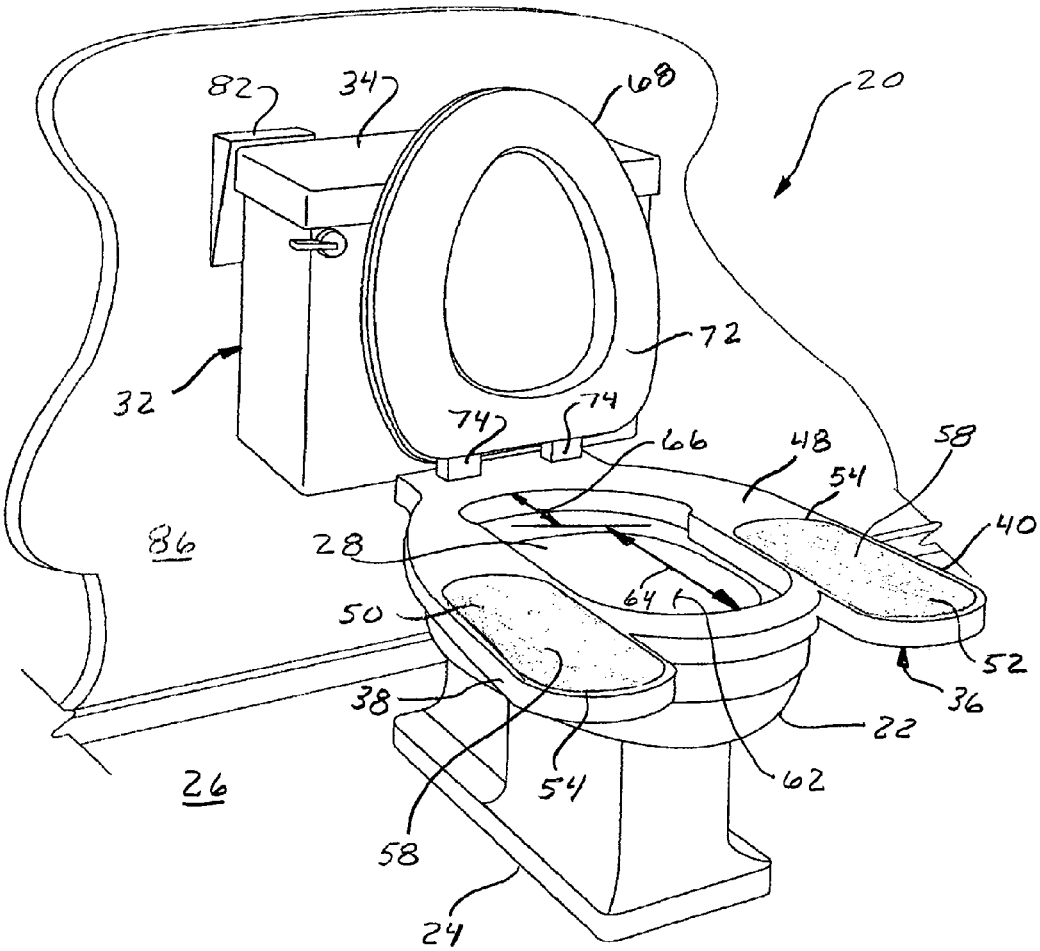
FIG. 1 is a perspective view of a toilet in accordance with one embodiment of the invention.
Figure 5:
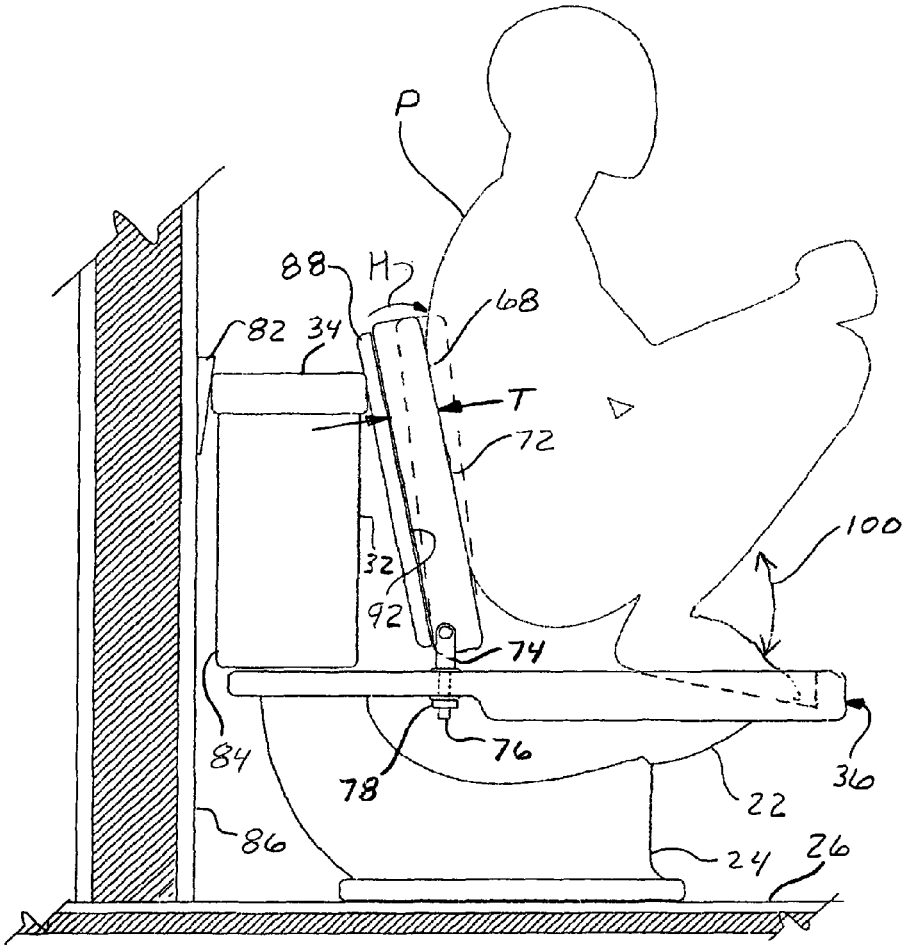
FIG. 5 is a side elevation view of the toilet of FIG. 1 showing its use by a person in a squatting posture.
Figure 6:
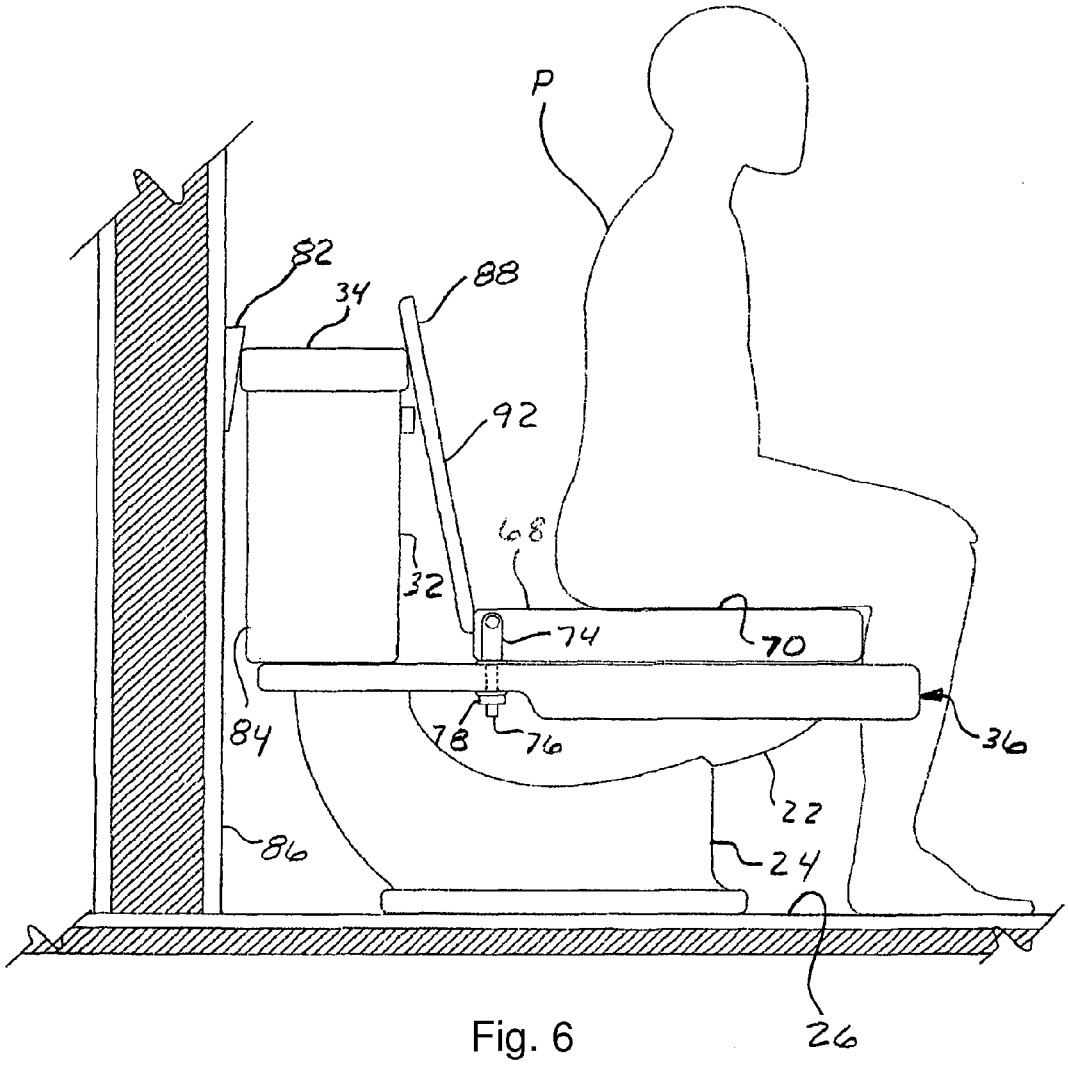
FIG. 6 is a side elevation view of the toilet of FIG. 1 showing its use by a person in a sitting posture.

Referring to the FIG. 1, there is shown a toilet 20 in accordance with an embodiment of the present invention. Toilet 20 includes various features in accordance with the invention that enable the toilet to be used in a conventional seated position common in many Western societies, as shown in FIG. 6, as well as in a squatting position, as shown in FIG. 5.

Toilet 20 includes a bowl 22 supported by a base 24. Base 24 may be secured to a floor 26 in convention manner, such as by bolting. Bowl 22 and base 24 may be integrally manufactured from any of a variety of known materials, including but not limited to ceramics, glass reinforced epoxies, plastics, metal, and the like. Alternatively, bowl 22 and base 24 may be formed separately and joined together using any suitable means, such as adhesives, welding, bolting, and the like.

Figure 4:
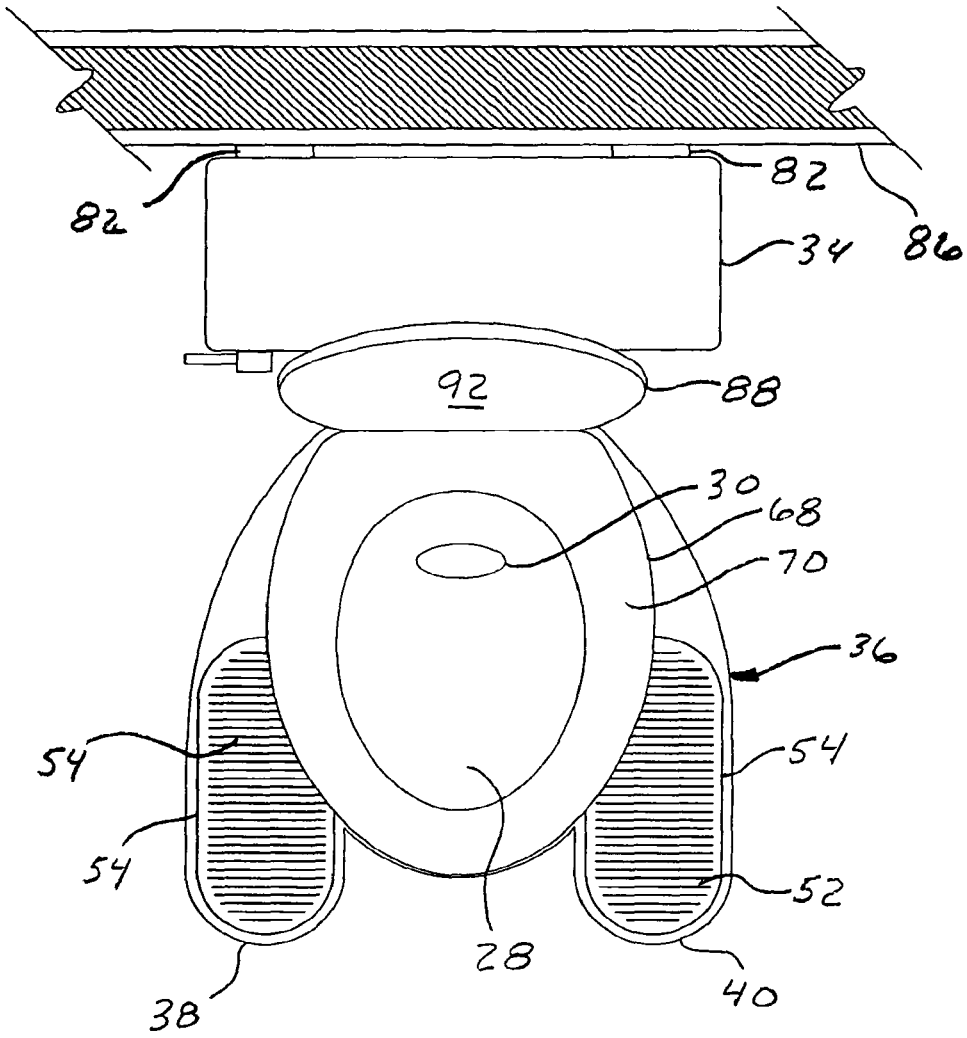
FIG. 4 is a top plan view of the toilet of FIG. 1.

Referring also to FIG. 4, Bowl 22 includes a recessed waste receptacle 28 for receiving waste material. Waste material deposited in receptacle 28 may be discharged through a passage 30, which may be connected to a known waste disposal system.

Toilet 20 may also include a water tank 32 for storing a quantity of water for delivery to waste receptacle 28 when the toilet is flushed. Water tank 32 is fluidly connected to receptacle 28 of bowl 22. Water tank 32 may include a flush valve, which when operated, causes water present in tank 32 to flow from the tank and into the receptacle, thereby causing any waste material present in receptacle 28 to be discharged through passage 30 to the waste disposal system. Tank 32 may be formed separate from bowl 22 and suitably connected thereto, or alternatively, may be formed integrally with the bowl. Although shown to have a generally rectangular shape, it shall be appreciated that tank 32 may also be configured in various other aesthetically pleasing shapes so as to provide the consumer with various decorative alternatives. Tank 32 may be manufactured from a variety of known materials, including but not limited to ceramics, glass reinforced epoxies, plastics, metal, and the like.

Tank 32 may include an opening positioned at the top of the tank to allow access to the flush valve in the event servicing of the valve is necessary. A cover 34, which is removably engageable with a rim of the opening, may also be provided.

To facilitate use of toilet 20 while in a squatting position (see FIG. 5), bowl 22 may include a support platform 36 extending from an upper rim region of receptacle 28. Support platform 36 may be integrally formed with receptacle 28 or may be otherwise suitably attached such as by bolts, glue or other means. Support platform 36 includes a right foot support 38 extending laterally outward from a right side of bowl 22 and a left foot support member 40 extending laterally outward from an opposite left side of bowl 22. Although shown to have generally plate-like configuration, it shall also be appreciated that the left and right foot supports 38 and 40 may also have a different configuration, such as a contoured lower surface, which may operate to provide additional support for the foot support members as well as providing various styling options.

Positioned along an upper surface 48 of support platform may be a right footpad 50 and a left footpad 52, respectively.

Footpads 50 and 52 may include a discernable edge 54 defining an outer perimeter of the footpad. Edge 54 assists a user with proper placement of the person's feet upon platform 36 when using toilet 20 in a squatting position. Upper surface 48 of bowl 22 may be lower to the ground than a conventional toilet so that it is easier for users to place their feet onto footpads 50 and 52.

Footpads 50 and 52 may include a textured surface 58, such as ridges, knurling, or similar protrusions, to enhance contact between an individual's feet and the footpads when using the toilet in a squatting position and to prevent individuals from sliding forward while in the squatting position. The texturing may be integrally formed as part of the left and right foot supports 38 and 40. Alternatively material having a sufficiently high coefficient of friction, such as rubber, may be suitably attached to the surface of the left and right foot supports 38 and 40.

Figure 2:
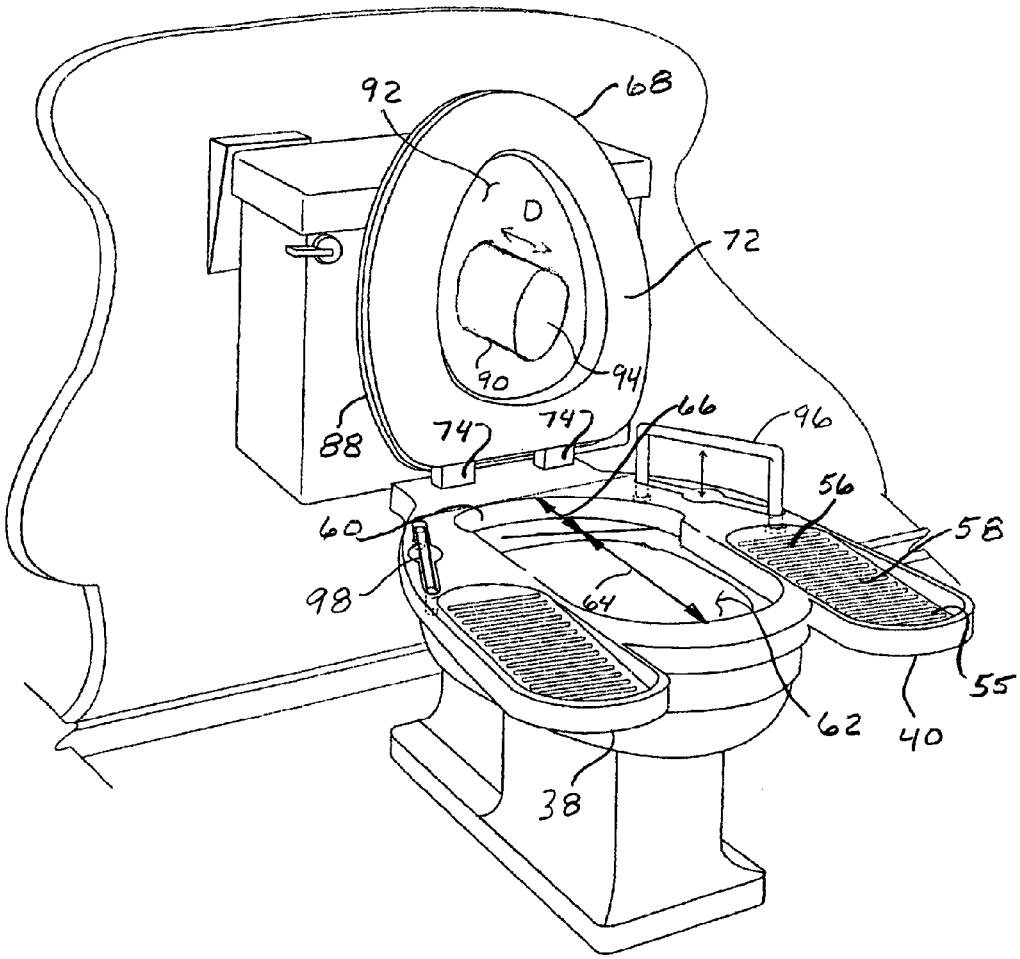
FIG. 2 is a perspective view of the toilet of FIG. 1 showing optional features.

Referring to FIG. 2, each footpad 50 and 52 may be slightly inclined upward from front to rear. This can be achieved by, among other ways, recessing a front portion 55 relative to a rear portion 56 of the footpads. Alternatively, the footpads 50 and 52 can be inclined by extending the rear portion 56 above upper surface 48 of platform 36. Inclining footpads 50 and 52 in this manner will cause the balls of the feet of an individual positioned in a squatting position on toilet 20 to be positioned lower than the heels of the person's feet. This is advantageous for reducing the tension exerted on the individual's Achilles' tendon when squatting. Note that the incline of footpads 50 and 52 is illustrated only in FIGS. 2 and 5.

Referring to FIG. 1, an interior edge surface 60 of platform 36 defines an opening 62 through which waste material may be deposited into receptacle 28. Opening 62 may be generally oval-shaped. It may also be desirable that the forward portion 64 of opening 62 be tapered to have a somewhat more narrow width than the aft portion 66. Narrowing forward portion 64 relative to aft portion 66 will enable footpads 50 and 52 to be placed closer together, which may facilitate more comfortable squatting.

Referring also to FIGS. 5 and 6, toilet 20 also includes a support member 68 with a first seat surface 70 and a rear load-bearing surface 72 that can function as a seat when using the toilet in a seated position (as shown in FIG. 6), and as a torso load-bearing support operable to facilitate positioning of the pelvis of the individual relative to receptacle 28 when using the toilet in a squatting position (as shown in FIG. 5). Support member 68 is pivotally attached to a rear portion of platform 36 by means of one or more hinges 74. Hinges 74 may be secured to platform 36 using bolts 76 and nuts 78. Hinges 74 enable support member 68 to be pivoted between a generally horizontal or "down" position, in which the support member is positioned for use as a seat, as shown in FIG. 6, and a non-horizontal or "up" position, in which the support member is positioned for use as a torso support when using toilet 20 as a squatting toilet, as shown in FIG. 5.

In its up position, the longitudinal axis of support members 68 forms an angle of between 90 and 125 degrees from the longitudinal axis of support member 68 in the down position. In other words, when support member 68 is in the up position, rear load-bearing surface 72 forms an angle of between zero and 35 degrees from the vertical.

Referring to FIGS. 4 and 6, support member 68 includes an opening 80 which overlays receptacle 28 when the support member is positioned in the seated position, thereby enabling the support member to operate as a conventional toilet seat. When support member 68 is in the seated position, the user's buttocks may rest on seat surface 70, as shown in FIG. 6. Seat surface 70 may be contoured or include padding to provide a comfortable seating surface. At least a portion of rear load-bearing surface 72 engages upper surface 48 of platform 36 when support member 68 is positioned in the seated position, as shown in FIG. 6.

Figure 3:
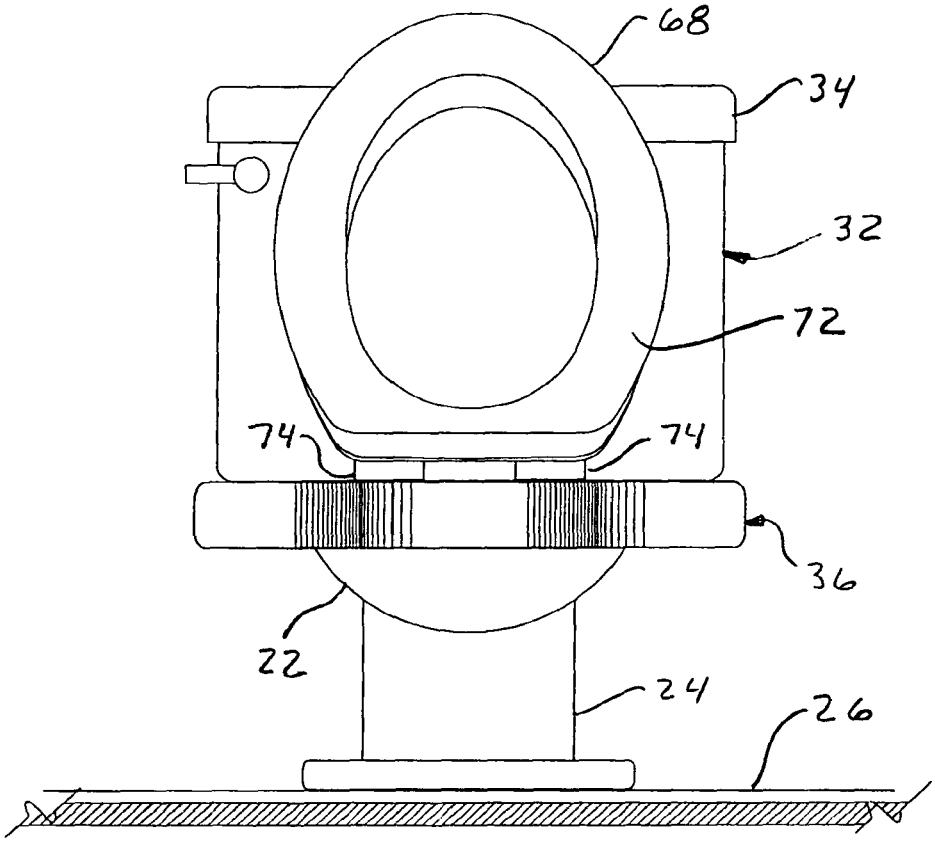
FIG. 3 is a front elevation view of the toilet of FIG. 1.

Referring to FIGS. 1, 3 and 5, support member 68 may be pivoted into an upright position when using toilet 20 as a squatting toilet in accordance with the invention. When in its upright position, support member 68 presents its rear load-bearing surface 72 toward the user, so that the user can lean his or her torso thereupon while assuming the squatting position of the present invention. The underside surface of a conventional toilet seat commonly has various protrusions and raised ridges resulting in localized bearing points that render a conventional toilet unsuitable for operating as a torso support. In contrast, load-bearing surface 72 of support member 68 preferably has a surface substantially free of any protrusions, ridges, and the like, which would create uncomfortable localized pressure points along a person's back. This can be accomplished, for example, by providing load-bearing surface 72 with a relatively smooth flat surface. Load-bearing surface 72 may also include padding and/or be contoured to conform with a person's back so as to more uniformly distribute the bearing load across a person's back region when squatting on toilet 20.

Referring to FIGS. 4 and 5, in order to provide sufficient load bearing support for support member 68 when using toilet 20 in the squatting position, it may be desirable to position a shim or other suitable load transferring member 82 between a rear surface 84 of the top of water tank 32, and a suitable load bearing member, such as a wall 86 against which toilet 20 may be placed. Load transferring member 82 operates to transfer load being applied to support member 68 onto wall 86, to avoid applying a torsion force to the bottom of tank 32 or the piping (not shown) coming into toilet 20.

Toilet 20 may include a cover 88 adjacent to support member 68. An edge of cover 88 is pivotally attached to support platform 36, enabling cover 88 to be moved between a generally vertical position, so as to enable access to waste receptacle 28, and a generally horizontal position in which cover 88 overlays opening 80 of support member 68 to prevent viewing and/or access to waste receptacle 28 when toilet 20 is not in use.

Referring to FIG. 2, additional and alternative features of the invention are illustrated. To provide additional means of rear load-bearing support, as well as enhanced comfort when using toilet 20 in a squatting position, cover 88 may optionally include a projection 90 extending from a lower surface 92 of cover 88 to define a load-bearing end surface 94. Projection 90 extends through opening 80 of support member 68 when cover 88 and support member 68 are positioned immediately adjacent to one another in the vertical position. Projection 90 extends a sufficient distance from surface 92 of cover 88 so that load-bearing end surface 94 is aligned generally flush with surface 72 of support member 68 when cover 88 and support member 68 are positioned adjacent to one another. Alternatively, projection 90 may be of a greater length so that its end surface 94 protrudes beyond surface 72 when cover 88 and support member 68 are positioned adjacent to one another. When end surface 94 protrudes beyond surface 72, and cover 88 and support member 68 are in the vertical or horizontal positions (such as depicted in FIGS. 5 and 6), and the user assumes a squatting position, then the user's torso may engage only the load-bearing end surface 94 and not engage the load-bearing surface 72. This may be advantageous because load-bearing surface 72 may be splattered with bodily wastes when support member 68 is placed in the horizontal position and used as a seat (as depicted in FIG. 6), and some users in that case may prefer not to place their bodies in direct contact with a dirty load-bearing surface 72.

Continuing to refer to FIG. 2, toilet 20 may optionally include one or more handles 96 and 98 that can be grasped by a user when assuming a squatting position on toilet 20. Handles 96 and 98, if used, may extend from upper surface 48 of support platform 36. The handles may be attached to platform 36 in a permanently upright position or may be retractable into platform 36 when not in use. Handle 96 is shown positioned in the extended position, whereas handle 98 is shown in the retracted position. Note that handles 96 and 98 are illustrated only in FIG. 2.

Referring to FIG. 5, the operation of the embodiment of FIG. 1 is illustrated. Many persons raised in a Western society are not physically conditioned to maintain a free-standing squatting position in a relaxed and comfortable manner. In particular, they lack the strength and flexibility to squat without excessive strain and tottering. In accordance with the present invention, a user P mounts the toilet 20 to defecate and/or as shown. The user is placed in a squatting position in which the feet are forward of the body's center of gravity and the upper body is supported by rear load-bearing surface 72 of support member 68. User P's left and right feet rest on foot pads 52 and 50, respectively. A portion of the user's posterior torso above his or her buttocks engages rear load-bearing surface 72 of support member 68. The rear load-bearing support surface 72 and foot pads 50 and 52 are spaced apart a distance to hold the user's weight with the user's pelvis suspended over the opening of waste receptacle 28. In this posture, the user's anal canal (not shown) is optimally aligned with is rectum to permit easy and complete evacuation of feces. By using the rear load-bearing surface, weight is taken off the feet, which relieves leg muscles from having to support the user in a perched squatting posture, thereby enabling the legs muscles to relax. This posture also facilitates urination and increases urine flow by reducing the angulation of the urinary sphincter and urethra and using the bellows action of the thighs against the abdomen to expel urine more efficiently and completely from the bladder.

When in the position shown in FIG. 5, the individual's center of gravity may be positioned between the individual's heels and surface 72 of support member 68. This is in contrast with a typical unassisted squatting position in which an individual's center of gravity is positioned between the heels of their feet and the ends of their toes. Shifting the center of gravity behind the heels allows an individual to lean back relative to his or her feet, thus increasing the angle 100 between the soles of the feet and the tibia, thereby reducing the strain on the Achilles' tendon, which in turn enables an individual to assume a more comfortable squatting position than in a traditional squatting position, where the angle between the feet and the tibia would be smaller. Further relaxation of the Achilles' tendon may be provided by elevating the heel portion of the foot rest as shown in FIG. 5.

When positioned in a squatting position with the individual's back resting against surface 72 of support member 68, the individual's torso may be positioned in a generally upright position. It may also be desirable to mount support member 68 on a means for adjusting the position of the support member 68 relative to a user's torso, such as a sliding or similar mount to permit lateral adjustment of support member 68 to accommodate users and toilets of various sizes. Alternatively, the position of support member 68 relative to a user's torso may be adjusted by adjusting the thickness T of the support member, such as by using more or less padding. Generally, to ensure that a person's pelvis is suitably positioned relative to receptacle 28, support member 68 may have a thickness "T" greater than that of a conventional toilet seat that enables a person in a squatting position to make weight bearing contact on surface 72 of support member 68 while the person's anus is suspended over receptacle 28, as shown in FIG. 5.

An alternative means of adjusting the position of support member 68 relative to a user's torso is to provide a ratchet mechanism in hinge 74. The ratchet permits pivoting movement of support member 68 in the forward direction of arrow H as shown in FIG. 5, but restrains pivoting movement in the opposite direction. This allows support member 68 to be pivoted into a position where it engages a user's torso when the torso is in a desired posture. Note that when a ratchet mechanism is used in hinge 74, the load borne by support member 68 will not be transmitted to tank 32 through load transferring member 82 to wall 86. Instead, the load will be borne by hinge 74 and bolts 76. In that case, it may be necessary (depending on the strength of the material of toilet 20) to provide reinforcement to hinge 74 or bolts 76.

Figure 7:
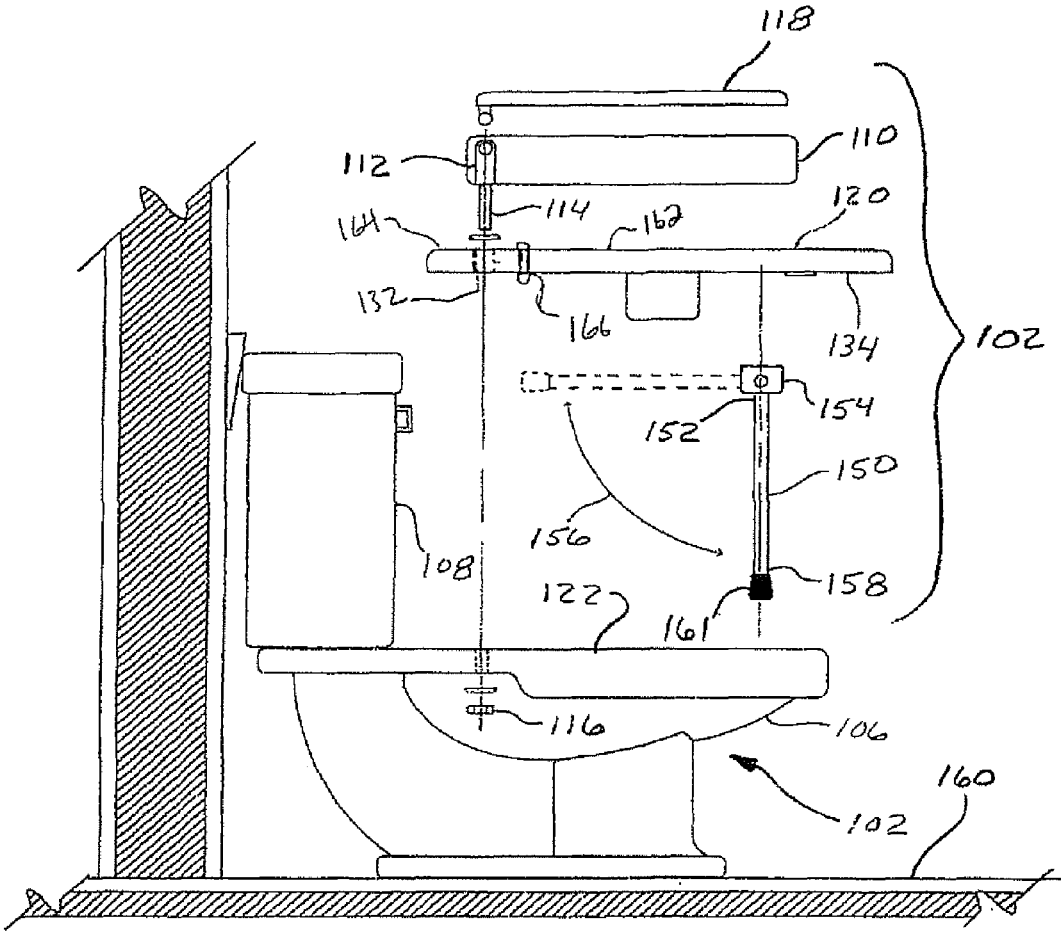
FIG. 7 is an exploded side elevation view of a toilet incorporating an accessory in accordance with a second embodiment of the invention.

Referring to FIG. 7, there is shown a squatting apparatus 102 for use with a conventional sitting toilet 104 having a bowl 106 and a water supply tank 108. Apparatus 102 may be used to conveniently retrofit toilet 104 so that it will accommodate defecation and urination in a squatting position as well as a sitting position. In this illustration, toilet 104 further includes a toilet seat 110 hingeably connected to bowl 106 using hinges 112, bolts 114, and nuts 116. A seat cover 118 may also be provided for overlaying seat 110 when positioned in a horizontal seating position.

Figure 8:
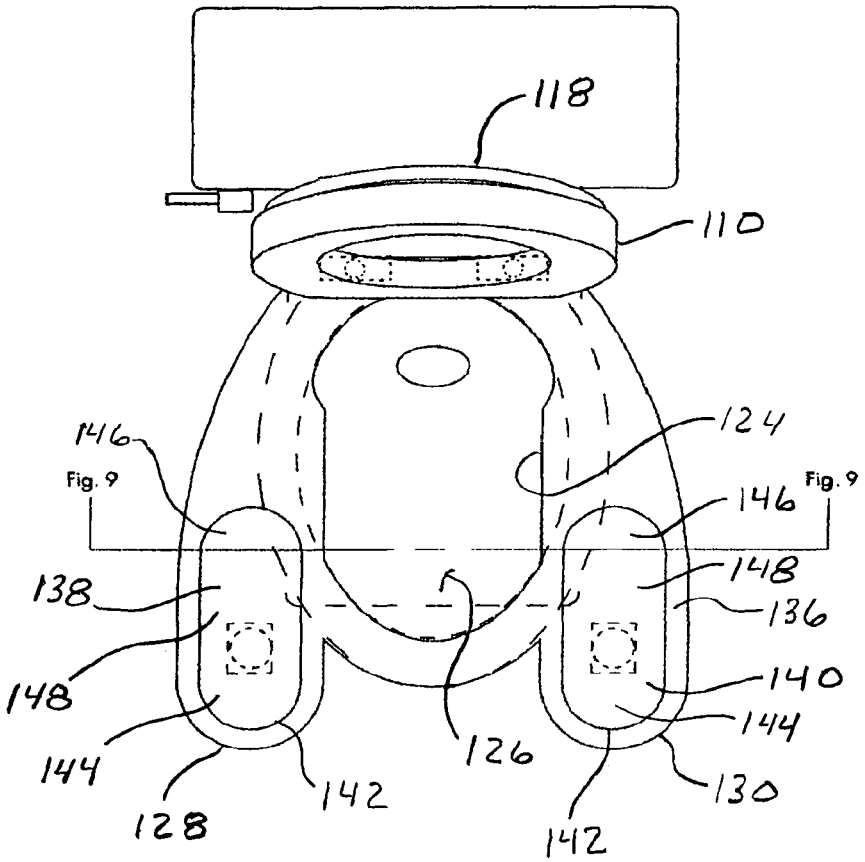
FIG. 8 is a top plan view of the accessory and toilet of FIG. 7.

Referring also to FIG. 8, squatting apparatus 102 includes a support platform 120 which is engageable with an upper rim 122 of bowl 106. Support platform 120 includes an opening 124 for enabling access to a recessed waste receptacle 126 of bowl 106 when support platform 120 is attached to bowl 106. Support platform 120 includes a right foot support member 128 and a left foot support member 130 positioned on opposite sides of opening 124. Foot support members 128 and 130 extend laterally outward from opening 124.

Figure 10:
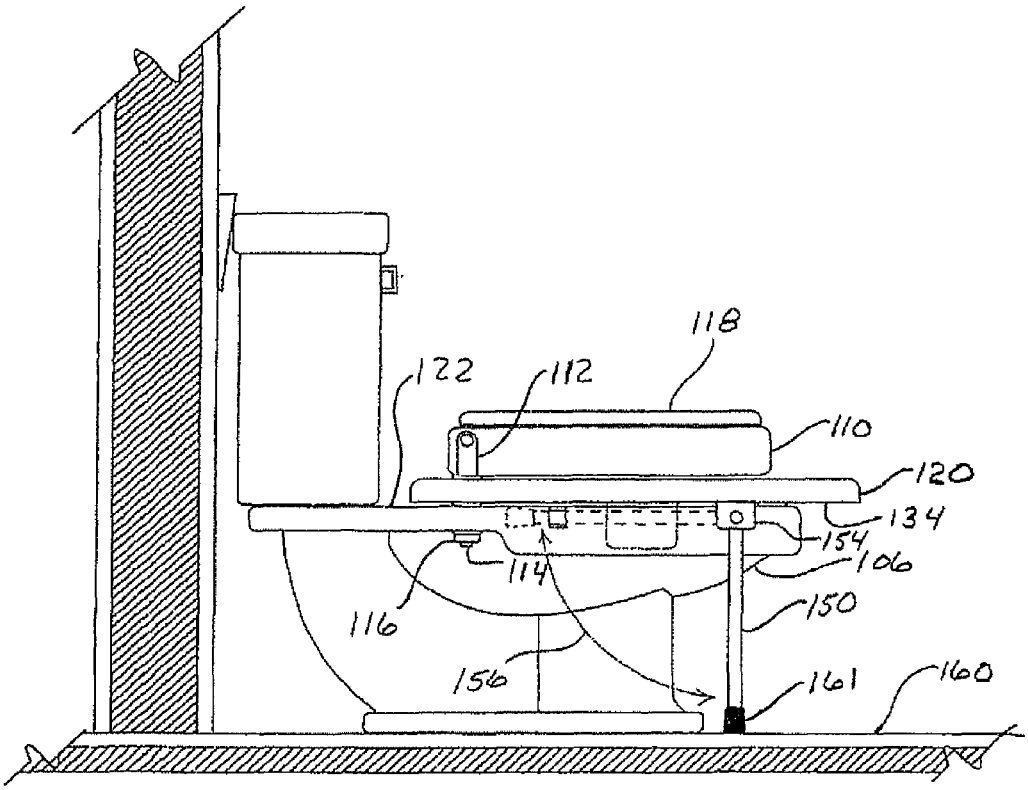
FIG. 10 is a side elevation of the accessory and toilet of FIG. 7.

Referring also to FIG. 10, support platform 120 may be attached to bowl 106 using bolts 114 for securing seat 110 to bowl 106. Support platform 120 includes one or more apertures 132 adapted for receiving bolt 114. If a preexisting toilet seat is attached to bowl 106, support platform 120 may be installed by first disassembling the preexisting toilet seat from bowl 106. With the preexisting seat removed from bowl 106, support platform 120 can be positioned over bowl 106 so as to engage a lower surface 134 of support platform 120 with rim 122 of bowl 106. Support platform 120 may be positioned relative to bowl 106 so as to align apertures 132 of support platform 120 with a corresponding bolt hole in bowl 106. Support platform 120 may be securely attached to bowl 106 using bolts 114 and nuts 116.

Continuing to refer to FIG. 8, positioned along an upper surface 136 of foot support members 128 and 130, is a right footpad 138 and a left footpad 140, respectively. Footpads 138 and 140 may each include a discernable edge 142 for defining an outer perimeter of each respective footpad. Edge 142 assists a user with proper placement of the person's feet upon platform 120 when using toilet 104 in a squatting position. Footpads 138 and 140 may each be slightly inclined from front to rear, as shown in FIGS. 1 and 2. This can be achieved by, among other ways, recessing a front portion 144 of the footpad relative to a rear portion 146. Alternatively, footpads 138 and 140 can be inclined by extending the rear portion 146 above upper surface 136 of platform 120. Inclining footpads 138 and 140 in this manner will cause the balls of the feet of an individual positioned in a squatting position on toilet 104 to be positioned lower than the heel of the person's feet. This is advantageous for reducing the tension exerted on the individual's Achilles' tendon in some individuals.

Footpads 138 and 140 may include a textured surface 148, such as ribs or knurling, to enhance contact between an individual's feet and the footpads when using the toilet in a squatting position. The texturing may be integrally formed as part of left and right foot support members 130 and 128, respectively. Alternatively, material having a relatively high coefficient of friction, such as rubber, may be suitably attached to the surface of footpads 138 and 140.

Figure 9:
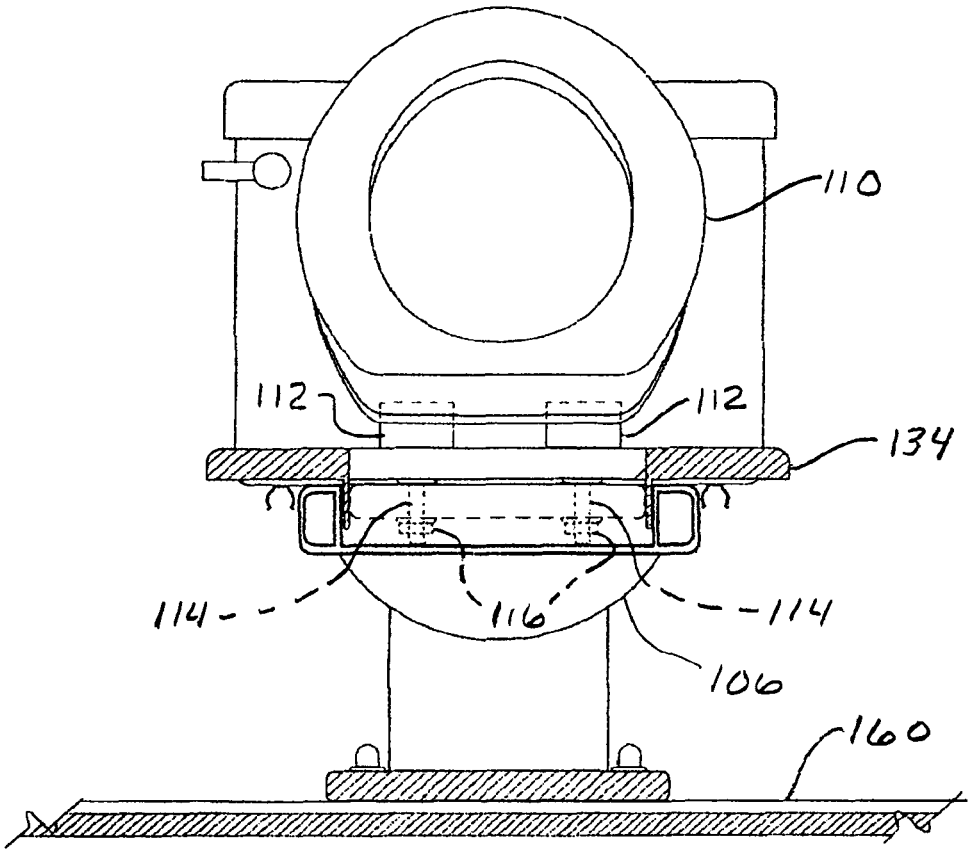
FIG. 9 is a sectional view of the accessory and toilet of FIG. 7, taken along the lines 9-9 of FIG. 8.

Referring also to FIGS. 9 and 10, squatting apparatus 102 may also include one or more elongated support legs 150. One end 152 of support leg 150 can be pivotally attached to the underside surface 134 of support platform 120 by means of a hinge 154. Hinge 154 enables support leg 150 to be pivoted into a stored position (as indicated by arrow 156 in FIG. 10) adjacent bottom surface 134 of platform 120 when platform 120 is separated from bowl 106. An opposite end 158 of support leg 150 can be engaged with a suitable support surface, such as a surface of floor 160, when platform 120 is attached to bowl 106. Legs 150 can be positioned substantially perpendicular to floor 160 to provide an efficient load path between the platform and the floor. A non-slip cap 161 may be attached to end 152 of support leg 150 to minimize the possibility that end 152 may slip relative to floor 160, as well as reducing the chance of support leg 150 marring floor 160. To be compatible with differently configured toilets, the support leg 150 can be telescopically extensible to accommodate varying distances between floor 160 and rim surface 122 of bowl 106. Alternatively, multiple support legs having differing lengths may also be provided.

Referring to FIG. 7, support platform 120 can include a base portion 162 and a rear flange portion 164. The rear flange portion 164 includes an aperture 132 through which mounting bolts may placed. A hinge 166 or other suitable pivoting mechanism connects base portion 162 and rear flange portion 164 to permit base portion 162 to be swung upward, away from bowl 106 for cleaning the area between base portion 162 and bowl 106.

Figure 11:
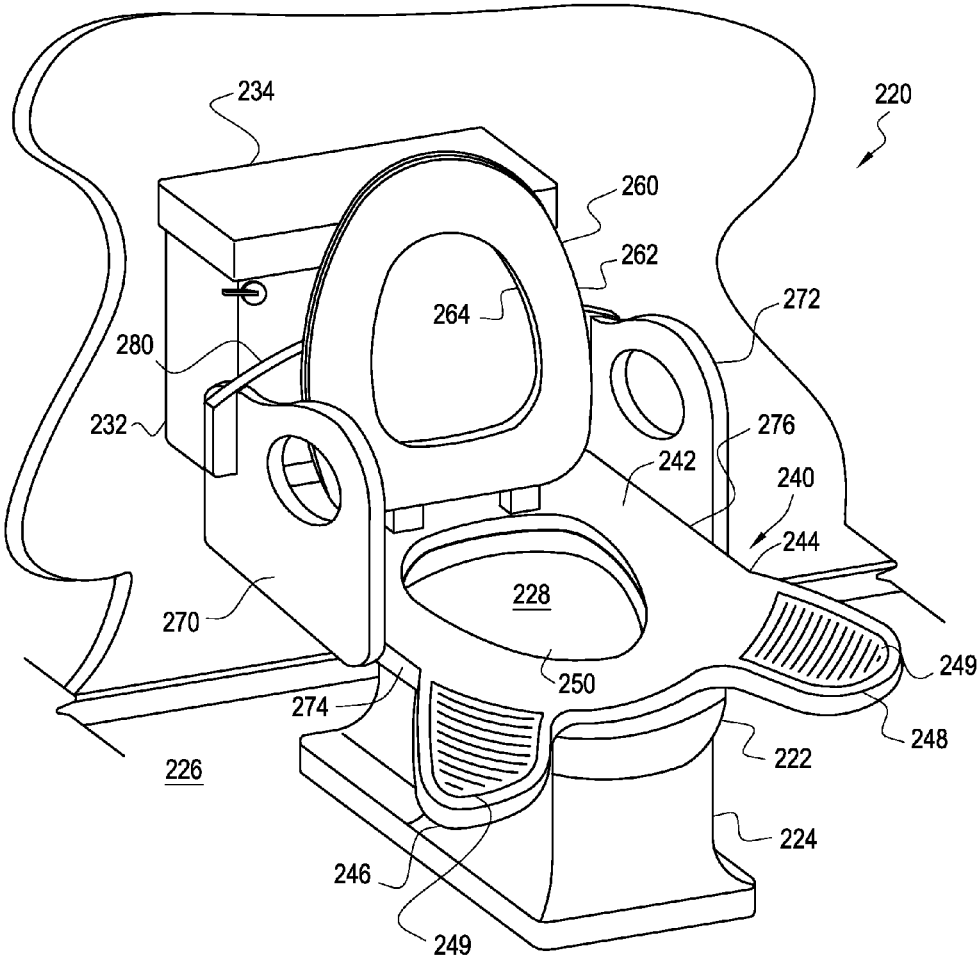
FIG. 11 is a perspective view of a toilet having a platform assembly according to a third embodiment.

FIG. 11 shows a toilet 220 having a platform assembly 240 according to a third embodiment.

The toilet 220 includes a toilet bowl 222, a base 224, and a receptacle 228 that permits entry of a person's waste products into the toilet bowl 222. The toilet 220 is supported by a floor 226 by connection of the base 224 to the floor 226. The toilet 220 may also include a water tank 232 that has a cover 234.

The platform assembly 240 includes a mounting flange 242 and a support platform 244. The mounting flange 242 is connectable to the toilet 220. The support platform 244 is connected to the mounting flange 242.

In the embodiment illustrated in FIG. 11, the mounting flange 242 and the support platform 244 are portions of a unitary structure. Thus, the mounting flange 242 and the support platform 244 are immovable with respect to one another, either by integral formation of the mounting flange 242 and the support platform 244, or by a rigid connection of the mounting flange 242 with respect to the support platform 244.

The support platform 244 defines a first foot support surface 246 and a second foot support surface 248. The first and second foot support surfaces 246, 248 are spaced apart with respect to one another. Non-slip areas 249 such as textured areas, rubber pads or other non-smooth features may be present of the first and second foot support surfaces 246, 248 to enhance grip.

The support platform 244 defines a gap 250 through which the person's waste products can pass. The gap 250 may be disposed partially between the first and second foot support surfaces 246, 248. At least a portion of each of the first foot support surface 246 and the second foot support surface 248 is disposed entirely forward of the toilet bowl 222.

The mounting flange 242 of the platform assembly 240 is rigidly connectable to the toilet bowl 222. As an example, at least one aperture (not shown in FIG. 11) can be formed in the mounting flange 242 that to allow connection of the mounting flange 242 to the toilet bowl 222 using a mounting bolt (not shown in FIG. 11). A mounting bolt arrangement such as the one shown in FIGS. 7 and 9 with respect to bolts 114 and nuts 116 can be utilized. Other structures can be utilized to rigidly connect the mounting flange 242 to the toilet bowl 222.

The platform assembly 240 includes a back support defining member, such as a toilet seat 260 that has a load bearing surface 262 for engaging the back of a person squatting over the toilet bowl 222. The load bearing surface 262 can be a lower surface of the toilet seat 260. The load bearing surface 262 can be cushioned to provide a comfortable surface for engaging the back of the person who is squatting over the toilet bowl 222.

The toilet seat 260 can be movable between an up position and a down position, such as by a pivotal mounting with respect to the mounting flange 242 and the support platform 244, When in the up position, the load bearing surface 262 of the toilet seat 260 is capable of defining an angle between 90 and 120° with respect to the support platform 244 of the platform assembly 240. When in the down position, the toilet seat 260 defines a seating surface 264 for engaging the buttocks of a person sitting over the toilet bowl 222.

One or more handles can be connected to the platform assembly 240. For example, a first handle 270 and a second handle 272 can be positioned along a first lateral side 274 and a second lateral side 276 of the platform assembly 240. The first handle 270 and second handle 272 are connected to the platform assembly 240 in any suitable manner, such as a rigid connection or a pivotal connection.

The first handle 270 and the second handle 272 can be connected to the platform assembly 240 adjacent to the mounting flange 242. Furthermore, the first handle 270 and the second handle 272 can be connected to the support platform 244. The first handle 270 and the second handle 272 both extend upward with respect to the support platform 244.

A lateral brace 280 can be connected to the platform assembly 240 for engaging and at least partially supporting the toilet seat 260 when it is in the up position. Thus, the lateral brace 280 can be utilized to support a portion of the load that is incurred when a person who is squatting over the toilet bowl 222 uses the load bearing surface 262 of the toilet seat 260 to provide back support.

The lateral brace 280 can be supported by the first handle 270 in the second handle 272. Furthermore, the lateral brace 280 can extend from the first handle 270 the second handle 272. This can be accomplished by connecting the lateral brace 280 the first handle 270 and the second handle 272 in any suitable manner, for example, using fasteners.

In a particular example, the lateral brace 280 can be connected to the first handle 270 and the second handle 272 by engagement of cooperating slots 282, 284, which are formed in the first and second handles 270, 272, and the lateral brace 280, respectively.

The lateral brace 280 can be positioned adjacent to a rear edge 286 of the platform assembly 240. Other suitable locations could be selected for the lateral brace 280.

Figure 12:
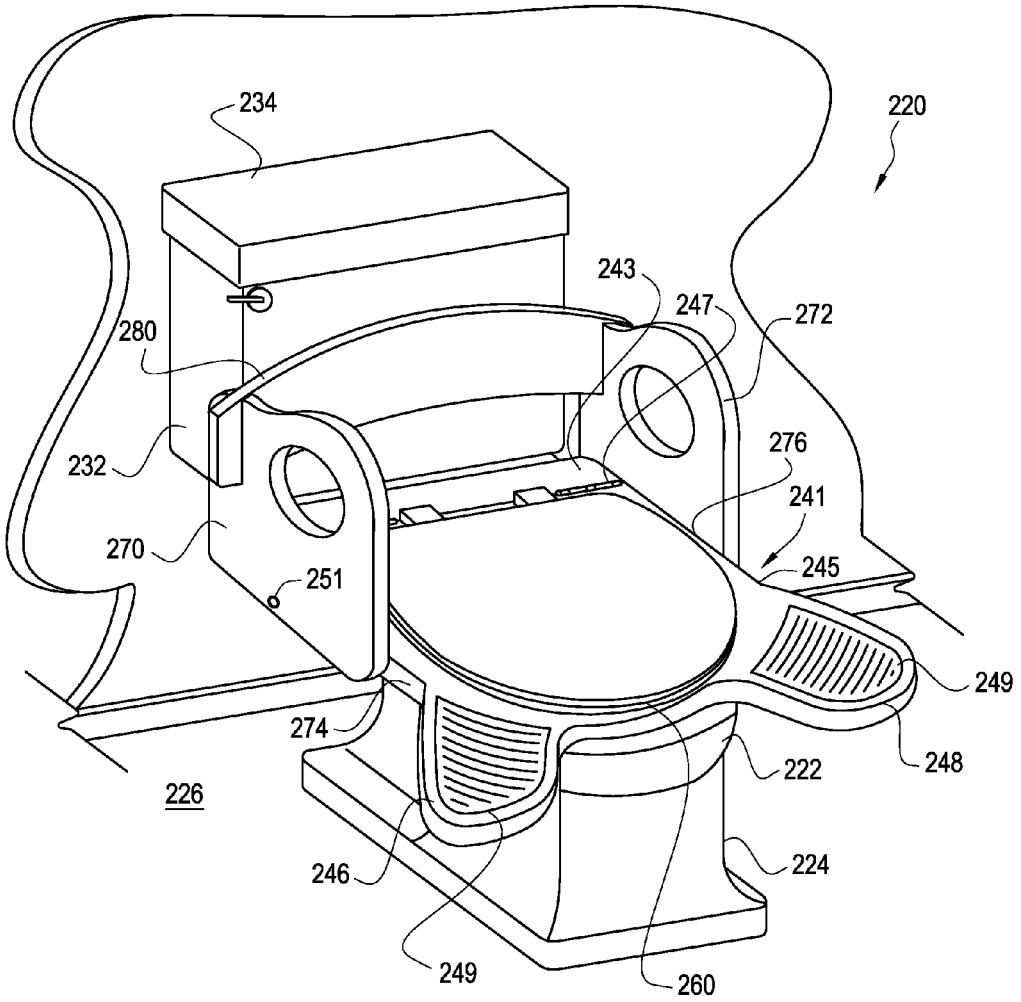
FIG. 12 is a perspective view of a toilet having a platform assembly according to a fourth embodiment.
Figure 13:
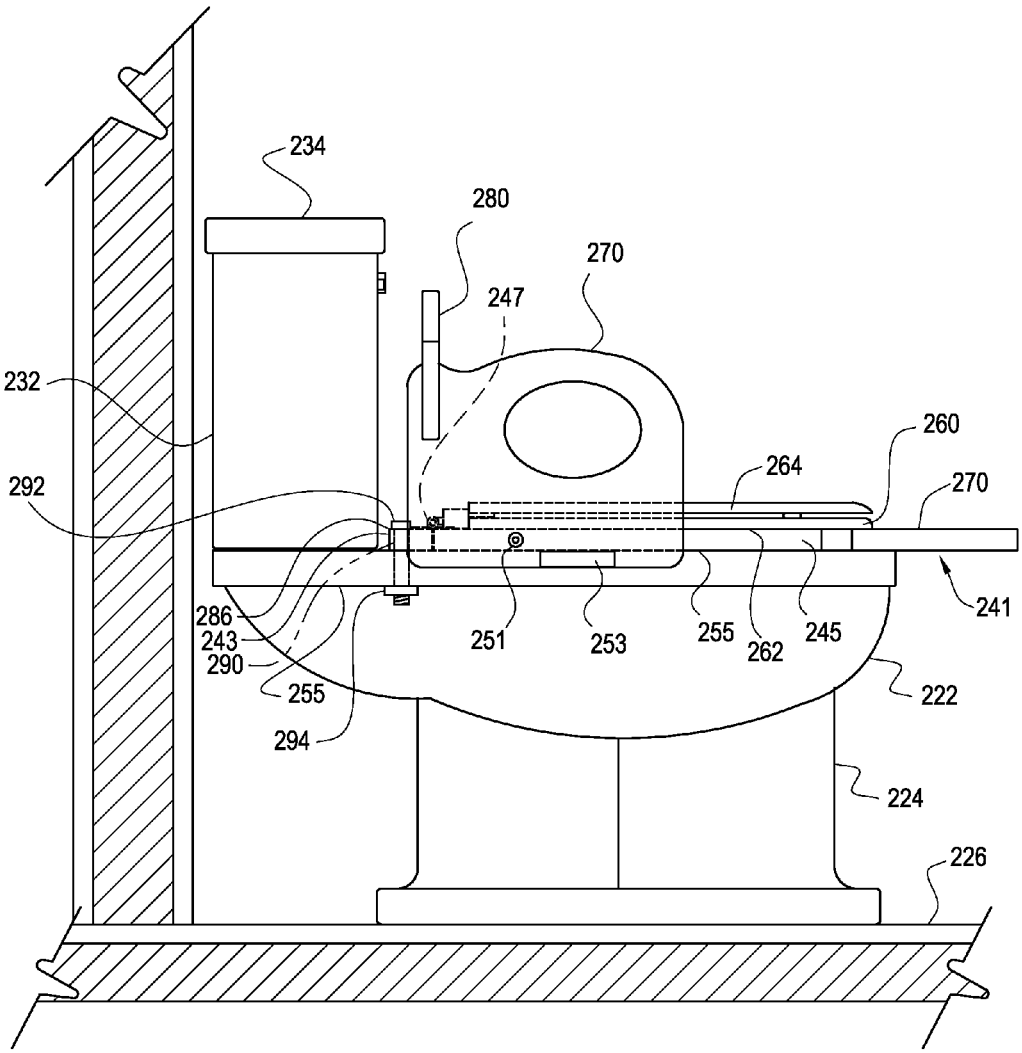
FIG. 13 is side elevation view of the toilet having the platform assembly of FIG. 12, wherein a support platform is in a lowered position.
Figure 14:
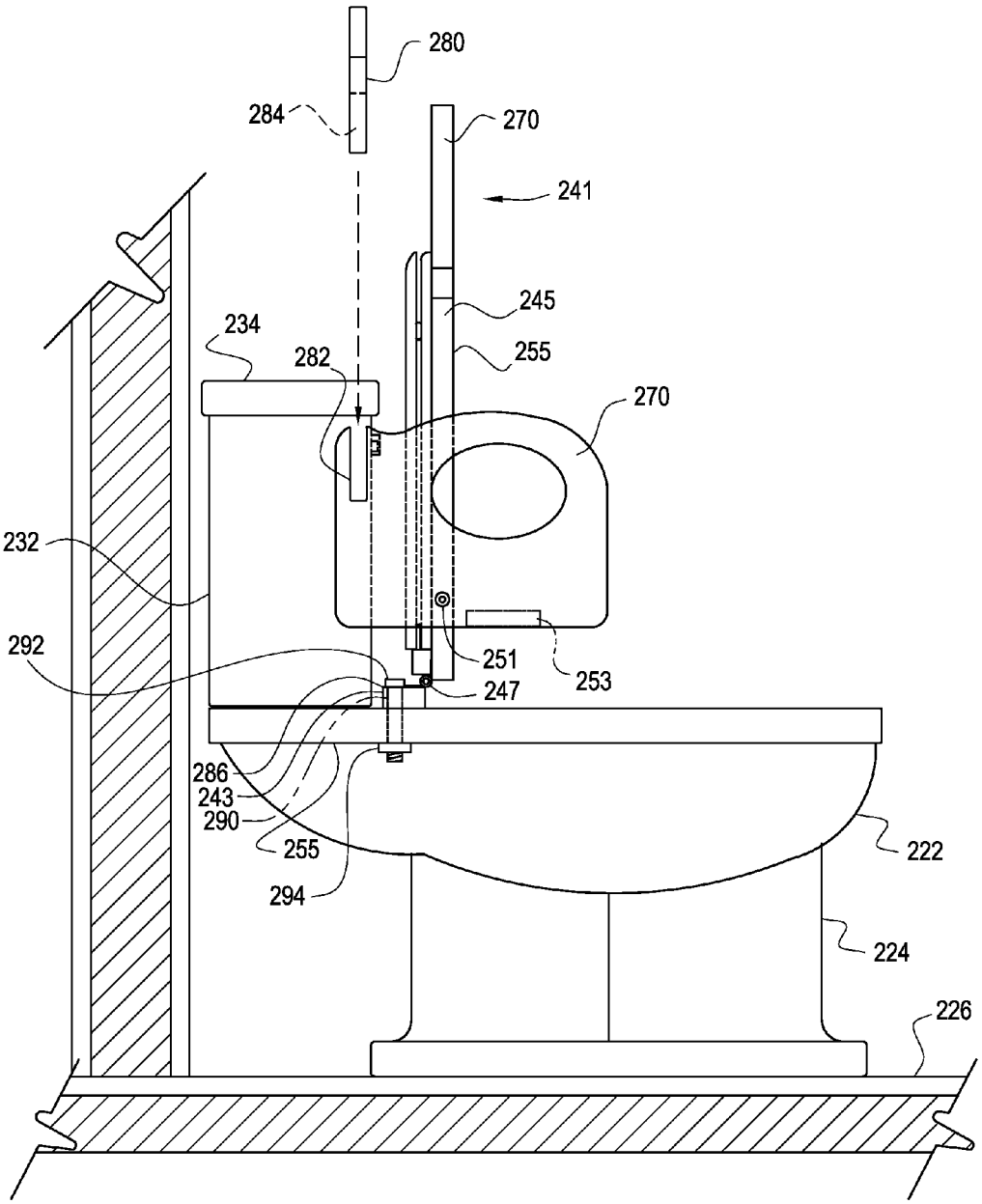
FIG. 14 is side elevation view of the toilet having the platform assembly of FIG. 12, wherein a support platform is in a raised position.

FIGS. 12-14 show a toilet 220 having a two-part platform assembly 241 according to a fourth embodiment.

The two-part platform assembly 241 is similar to the platform assembly 240 depicted in FIG. 12, with the exception that the platform assembly 241 includes separately formed portions, namely a mounting flange 243 and a support platform 245 that are pivotally connected to one another by hinges 247. Pivoting of the support platform 245 with respect to the mounting flange 243 allows the support platform 245 to be pivoted between a lowered position (FIGS. 12-13) and a raised position (FIG. 14) at the hinges 247 to allow cleaning of the toilet bowl 222.

The lateral brace 280 can be disconnectable from the first handle 270 and the second handle 272 in order to prevent interference between the lateral brace 280 and the tank 232 when the support platform 245 is pivoted to its raised position. Also, the first handle 270 and the second handle 272 can be pivotally mounted to the support platform 245 by pivot pins 251, to allow pivoting of the first handle 270 in the second handle 272 with respect to the support platform 245 when it is pivoted to its raised position. This allows the first handle 270 and the second handle 272 to retain a substantially upright angular orientation with respect to the toilet 220 as the support platform 245 is pivoted to its raised position.

Stop blocks 253 can be mounted to each of the first handle 270 and the second handle 272 and oriented inwardly for engagement with a lower surface 255 of the support platform 245 in order to limit rotation of the first handle 270 and the second handle 272 with respect to the support platform 245.

As best shown in FIGS. 13-14, a pair of apertures 290 is formed through the mounting flange 243 of the platform assembly 241. the apertures 290 are sized to receive toilet mounting bolts 292. Thus, the toilet mounting bolts 292 are extendable through the apertures 290 and also through corresponding apertures that are formed in the toilet 220. Nuts 294 are utilized to secure the bolts 292 with respect to the toilet 220.

Except as described above, the remainder of the apparatus shown in FIGS. 12-14 is identical to the one shown in FIG. 11, and the same reference numerals are utilized to show like parts.

Figure 15:
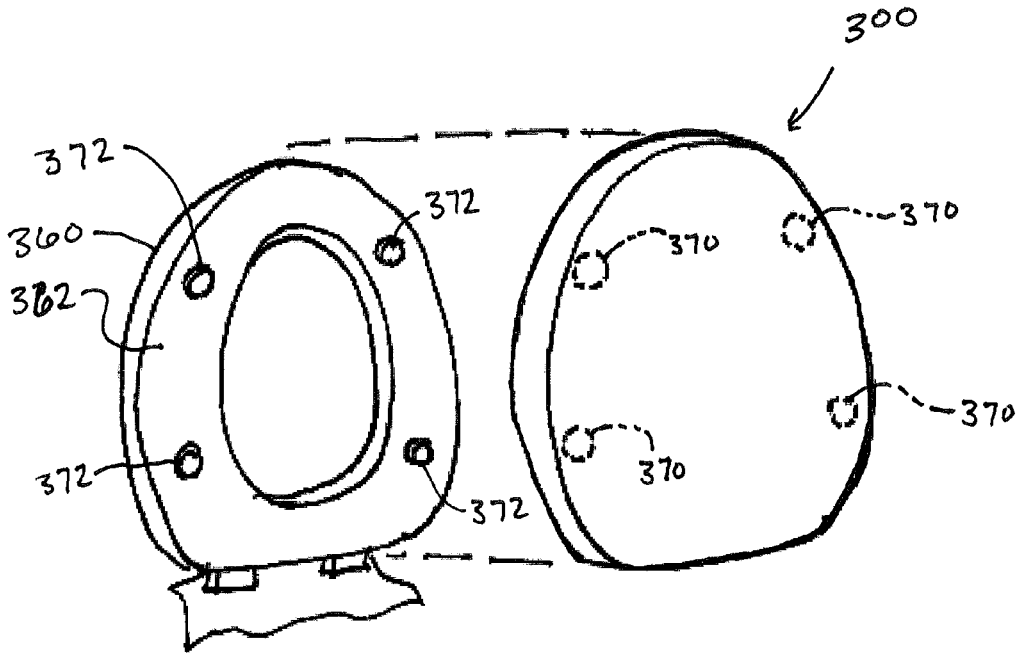
FIG. 15 is a perspective view of a cover member that is connectable to a toilet seat.

All of the previously described embodiments can be utilized with a cover member 300, as shown in FIG. 15. The cover member 300 is connectable to a back support defining member, such as a toilet seat 360 that has a load bearing surface 362 for engaging the back of a person squatting over a toilet bowl, as described previously. The cover member 300 is employed for sanitary purposes, i.e. preventing contact of the person's body with the toilet seat 360, for comfort purposes, by cushioning the person's back, or both.

The cover member 300 is detachably connected to the toilet seat 360 by fasteners. The fasteners could be in the form of two part fasteners having a first fastener portion 370 that is connected to the cover member and a second fastener portion 372 that is connected to the toilet seat 360, such as on the load bearing surface 362. The fasteners 370, 372 can be magnets, hooks, hook and loop fasteners, snap fasteners, friction fit fasteners, or any other suitable type of fastener. As an alternative, the second fastener portion 372 could be omitted if a single part fastener is used for the first fastener portion 370. Suitable examples of single part fasteners for use as the first fastener portion 370 include suction cups and releasable adhesives.

When the cover member 300 is not in use, it can be stored adjacent to a front surface of the tank 232 of the toilet 220. As an example, the cover member 300 can be stored between the tank 232 and the lateral brace 280. A bracket or other connecting structure can be provided for this purpose.

Figure 16:
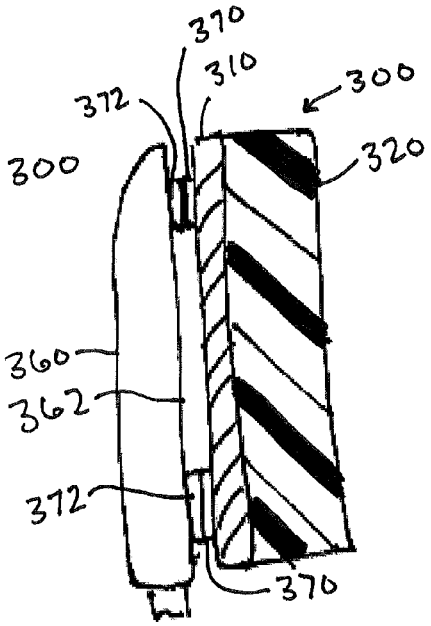
FIG. 16 is a side, cross-section view of the cover member and toilet seat of FIG. 15 connected to one another.

As shown in FIG. 16, the cover member can include a backer 310 and a cushion 320 that are connected to one another. The backer 310 can be rigid or semi-rigid, positionable adjacent to the load bearing surface 362 of the toilet seat 360, and have the first fastener portions 370 connected thereto. The cushion 320 can be fabricated from any suitable type of cushioning material, such as foam, to provide comfort to the person who is squatting over the bowl. The backer 310 and the cushion 320 are connected in any suitable manner.

Figure 17:
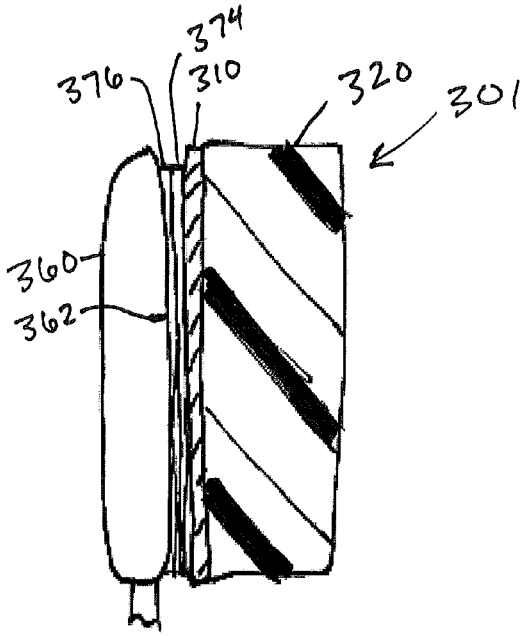
FIG. 17 is a side, cross-section view of an alternative cover member and toilet seat connected to one another.

As shown in FIG. 17, an alternative cushion member 301 is attached to the toilet seat 360 using first and second fastener portions 374, 376 in the form of cooperating track members.

Figure 18:
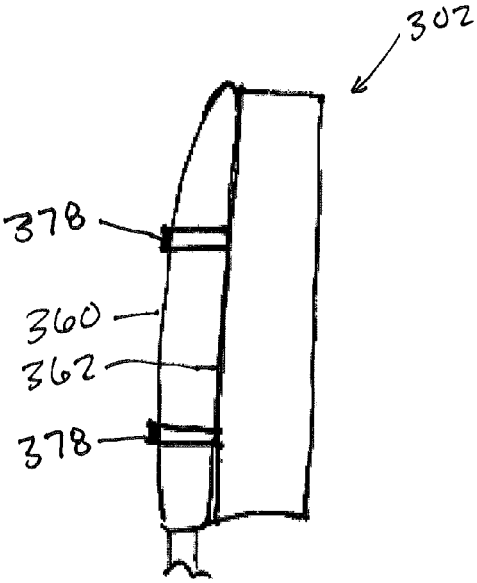
FIG. 18 is a side, cross-section view of another alternative cover member and toilet seat connected to one another.

As shown in FIG. 18, an alternative cushion member 302 is attached to the toilet seat 360 using straps 378.

Figure 19:
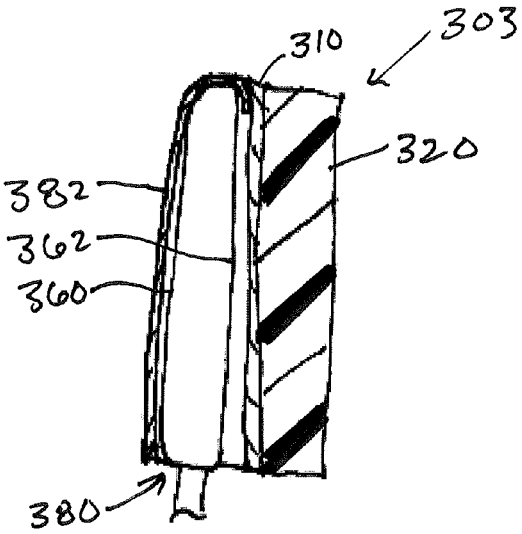
FIG. 19 is a side, cross-section view of another alternative cover member and toilet seat connected to one another.

As shown in FIG. 19, an alternative cushion member 303 is attached to the toilet seat 360 by disposing the toilet seat 360 within a pocket 380 that is formed by a pocket defining panel 382 of the alternative cushion member 303.

The alternatives described in connection with FIGS. 17-19 are similar to the structures shown in FIGS. 15-16 and utilize the same reference numerals for like parts except with regard to the modifications noted above.

The description of the invention is merely exemplary in nature, and thus, variations that do not depart from the gist of the invention are intended to be within the scope of the invention. Such variations are not intended to be regarded as a departure from the spirit and scope of the invention.

The invention claimed is:

1. An apparatus for use with an existing Western-style toilet having a toilet bowl, the apparatus facilitating use of a squatting posture thereon, comprising:

a platform assembly including:

a mounting flange that is connectable to the toilet bowl;

a support platform that is pivotally connected to the mounting flange, the support platform defining first and second spaced-apart foot support surfaces to support a person's feet and a gap through which the person's waste products can pass;

a first handle pivotally connected to a first side of the support platform and extending upward therefrom;

a second handle pivotally connected to a second side of the support platform and extending upward therefrom; and a lateral brace that extends from the first handle to the second handle, wherein the first handle, the second handle, and the lateral brace pivot with respect to the support platform when the support platform is moved between an up position and a down position.

2. An apparatus for use with an existing Western-style toilet having a toilet bowl, the apparatus facilitating use of a squatting posture thereon, comprising:

a platform assembly including:

a mounting flange that is connectable to the toilet bowl; and a support platform that is connected to the mounting flange, the support platform defining first and second spaced-apart foot support surfaces to support a person's feet and a gap through which the person's waste products can pass;

a first handle connected to a first side of the platform assembly;

a second handle connected to a second side of the platform assembly; and a lateral brace that extends from the first handle to the second handle.

3. The apparatus of claim 2, wherein the lateral brace is positioned adjacent to a rear edge of the platform assembly.

4. An apparatus for use with an existing Western-style toilet having a toilet bowl, the apparatus facilitating use of a squatting posture thereon, comprising:

a platform assembly including:

a mounting flange that is connectable to the toilet bowl;

a support platform that is connected to the mounting flange, the support platform defining first and second spaced-apart foot support surfaces to support a person's feet and a gap through which the person's waste products can pass;

a back support defining member that is connected to the platform assembly, the back support defining member having a load bearing surface for engaging the back of a person squatting over the bowl; and a lateral brace that is connected to the platform for engaging and at least partially supporting the back support defining member.

* * * * *